US006012308A

United States Patent [19]

Smulowitz

[11] Patent Number: 6,012,308

[45] Date of Patent: Jan. 11, 2000

[54] APPARATUS FOR MAGNETICALLY LAUNDERING GARMENTS

[75] Inventor: Marc S Smulowitz, Harveys Lake, Pa.

[73] Assignee: Marc Smulowitz, Harveys Lake, Pa.

[21] Appl. No.: 08/998,097

[22] Filed: Dec. 24, 1997

[51] Int. Cl.[7] ..... D06F 39/00

[52] U.S. Cl. ..... 68/235 R; 252/62.53; 252/62.54; 510/276; 510/439

[58] Field of Search ..... 68/213, 235 R; 210/222, 223, 695; 335/302, 303, 306; 252/62.53, 62.54; 510/276, 439

[56] References Cited

U.S. PATENT DOCUMENTS

| | | | |
|---|---|---|---|
| 3,206,657 | 9/1965 | Moriya | 335/303 X |
| 4,992,768 | 2/1991 | Mozis et al. | 335/302 X |
| 5,096,763 | 3/1992 | Ogata et al. | 335/303 X |
| 5,663,701 | 9/1997 | Kaura | 335/306 |
| 5,682,774 | 11/1997 | Baumgartner | 68/235 R |

*Primary Examiner*—Philip R. Coe

[57] ABSTRACT

An apparatus for magnetically laundering garments with permanent ceramic magnets compiled in unique configuration with a flux density of at least 3,900 gauss at a pole face thereof, thick plastisol casing to protect magnets from water and washing machine agitation; the magnet configuration ionizes water, increasing the natural solvency to assist in releasing stains and odors in fabrics; design, size and the casing make it practical for use in washing machine, uses specially calibrated magnetism to alter the basic nature of water and increase its natural solvency by ionization for usage in a laundry machine, and a preferred embodiment includes the magnets as a rare earth magnet.

3 Claims, 2 Drawing Sheets

10.

APPARATUS FOR MAGNETICALLY LAUNDERING GARMENTS

CROSS REFERENCE TO RELATED APPLICATIONS

Not Applicable

STATEMENT REGARDING FEDERALLY SPONSORED RESEARCH AND DEVELOPMENT

Not Applicable

REFERENCE TO A MICROFICHE APPENDIX

Not Applicable

BACKGROUND OF THE INVENTION

This invention relates generally to the field of garment cleaning maintenance, and more particularly to an apparatus for magnetically laundering garments.

Magnetism is a natural, well known force, and objects that employ it are known as magnets. By the close of the 1800's, all of the elements were known to have some magnetic characteristic. Those that lived in the ancient world could find the magnetic force because certain minerals and rocks are magnetic in their natural state. Materials which keep their magnetism autonomous of their environment are called permanent magnets.

Magnetic exertion always exists between permanent magnets. Permanent magnets also employ forces on specific other materials, such as iron, which alone do not display magnetic characteristics. All materials, even the so-labeled non-magnetic ones, can react to magnetic force. The apparatus for magnetically laundering garments uses specially calibrated magnetism to alter the basic nature of water and increase its natural solvency.

When water, or any stream of atoms enters a powerful magnetic field, it physically changes in the same way atoms change when run through particle accelerators used by physicists. In effect, the water is ionized. Negatively charged oxygen ions are stripped from stable water molecules and are freed to perform a number of tasks. Among other things, the altered water can dissolve scum lines, help stabilize pH, kill algae and microorganisms, and release stains and odors from fabrics.

There has been many applications for magnets in inventions previously. None of them have employed its unique energy for the application of laundering garments.

SUMMARY OF THE INVENTION

The primary object of the invention is to provide a viable alternative to using chemical soaps and detergents when doing laundry.

Another object of the invention is to lessen to need for detergents and fabric softeners by providing a well known process to ionize washing machine water and increase its natural solvency.

Another object of the invention is to reduce the amounts of potentially irritating detergent chemicals into the environment and onto garments.

A further object of the invention is to provide a hypoallergenic laundry detergent alternative for allergy sufferers.

Yet another object of the invention is to provide a reusable laundry detergent alternative.

Still yet another object of the invention is to provide an economical laundry detergent alternative.

Other objects and advantages of the present invention will become apparent from the following descriptions, taken in connection with the accompanying drawings, wherein, by way of illustration and example, an embodiment of the present invention is disclosed.

An apparatus for magnetically laundering garments comprising: Permanent ceramic magnets compiled in unique configuration comprising a flux density of at least 3,900 gauss at a pole face thereof; thick plastisol casing to protect magnets from water and washing machine agitation; said magnet configuration ionizes water, increasing the natural solvency to assist in releasing stains and odors in fabrics; design, size and said casing make it practical for use in washing machine; uses specially calibrated magnetism to alter the basic nature of water and increase its natural solvency by ionization for usage in a laundry machine.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
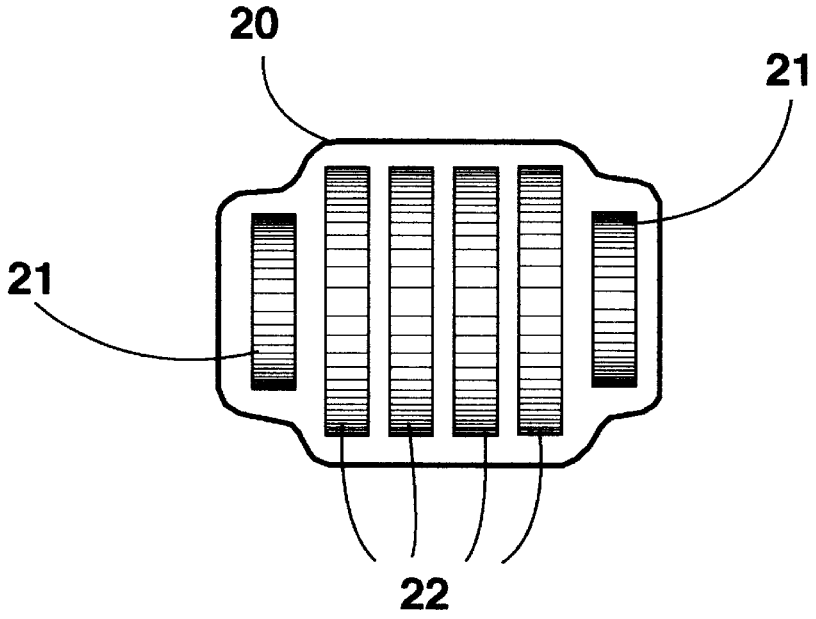
FIG. 1 is a cross sectional view of the invention.

Turning first to FIG. 1, a cross sectional view of the invention renders a detailed breakdown of components. Part 20 shows plastisol coating, parts 21 show small magnets, parts 22 show large magnets.

Figure 2:
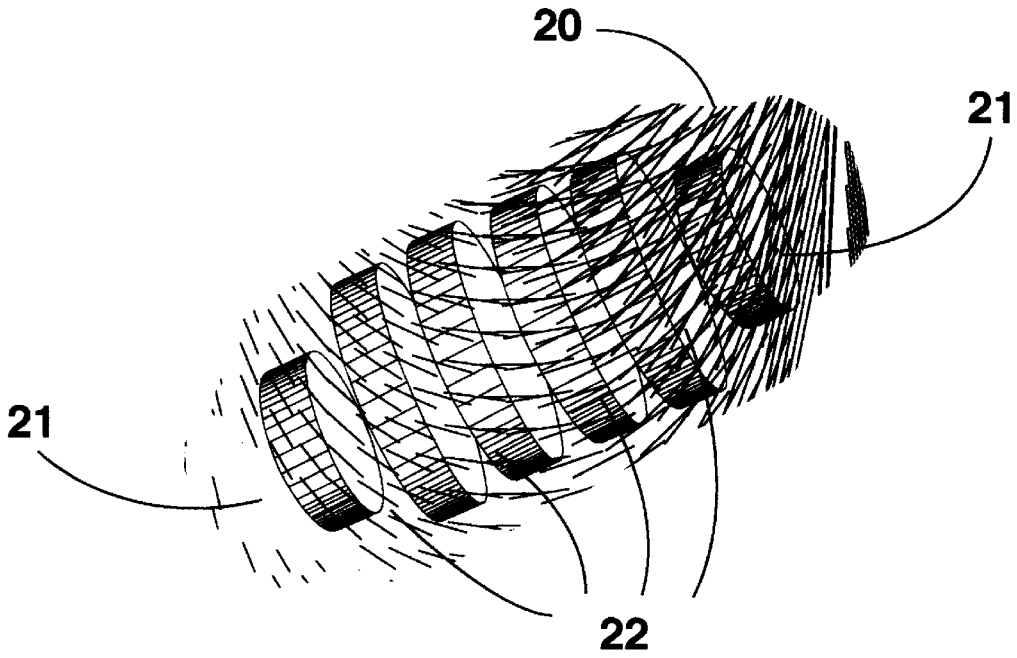
FIG. 2 is an exploded view of the invention.

Turning to FIG. 2, an exploded view detailed breakdown of components and how they interrelate to the whole. Part 20 shows plastisol coating, parts 21 show small magnets, parts 22 show large magnets.

Figure 3:
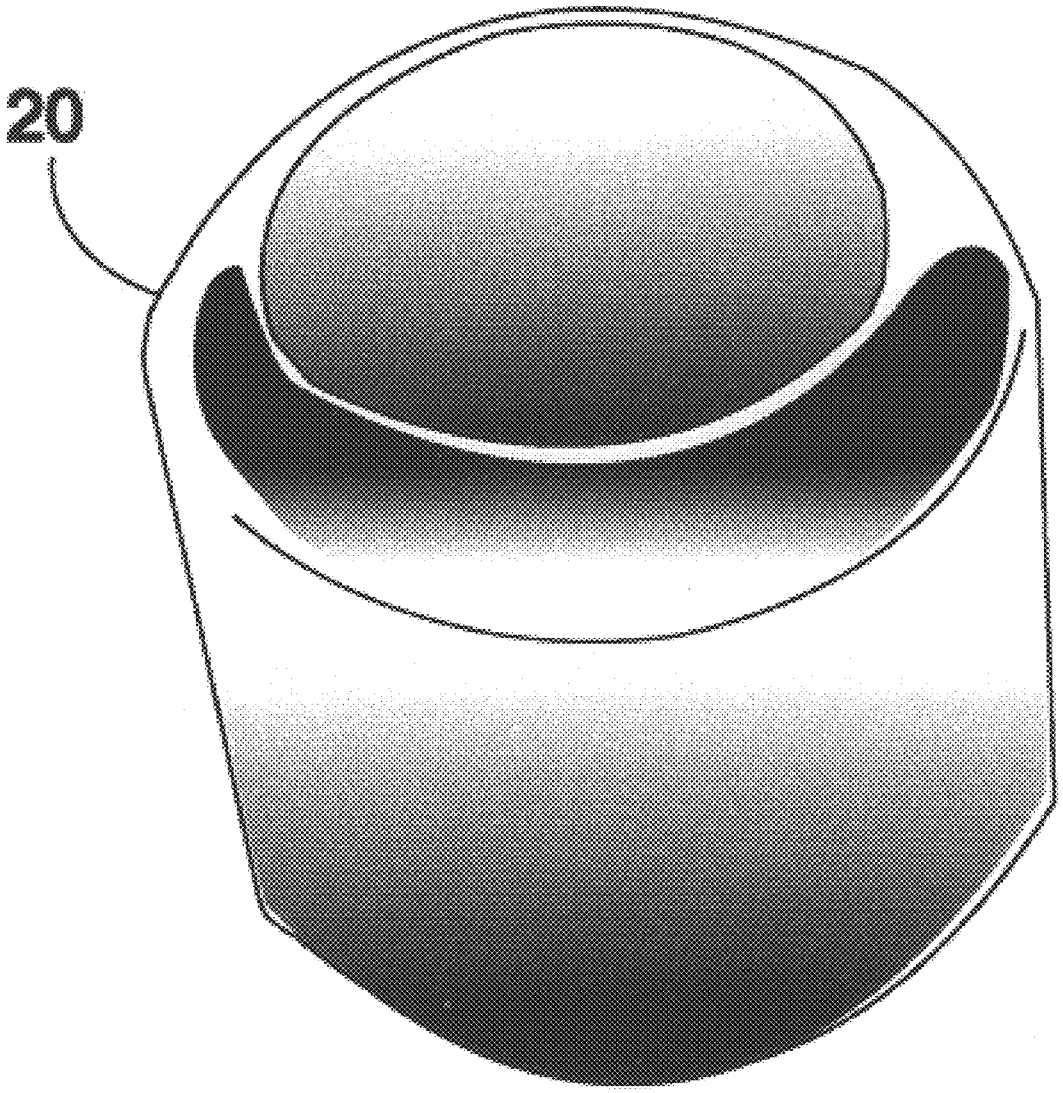
FIG. 3 is a perspective view of the invention.

Turning to FIG. 3, there is shown a complete mating of all components drafted in a perspective view. The joined magnetic components are meshed with the thick plastisol encasement to form a complete unit. Part 20 shows plastisol coating.

The invention is basically created by combining the appropriate magnet configuration, and then dipping them in hot plastisol coating to resemble the accompanied renderings. Once the encased unit is completely dry and hard, it may simply be placed on top of the garments inside of washing machine and operated as usual. The invention is an apparatus for magnetically laundering garments comprising: Permanent ceramic magnets compiled in unique configuration comprising a flux density of at least 3,900 gauss at a pole face thereof.

Thick plastisol casing to protect magnets from water and washing machine agitation. Said magnet configuration ionizes water, increasing the natural solvency to assist in releasing stains and odors in fabrics. Design, size and said casing make it practical for use in washing machine. Uses specially calibrated magnetism to alter the basic nature of water and increase its natural solvency by ionization for usage in a laundry machine.

Invention apparatus for magnetically laundering garments as claimed previously wherein said magnets is a rare earth magnet. Invention apparatus for magnetically laundering garments as claimed previously wherein said casing is rubber. As shown in the figures the shape of the apparatus is substanially cylindrical however, the shape of said apparatus may be substituted as square, rectangular, or any other practical shape; the size of said apparatus may be substituted as any size usable in a commercial or private use laundry washing machine. The said apparatus may be used in a commercial or private use dish washing machine.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An apparatus for magnetically laundering garments while immersed in wash water in a garment washing machine comprising:

a) a substantially cylindrical plastisol, waterproof casing; and b) a plurality of permanent ceramic magnets arranged within and completely encased by said casing, said magnets arranged in a cylindrical configuration substantially corresponding to that of said casing, the configuration of magnets providing a flux density of at least 3900 gauss at a pole face thereof such that a powerful magnetic field is provided in the wash water within the garment washing machine to ionize the water and thus clean the garments.

2. An apparatus for magnetically laundering garments as claimed in claim 1 wherein each said magnet is a rare earth magnet.

3. An apparatus for magnetically laundering garments as claimed in claim 1 wherein said casing is rubber.

* * * * *